United States Patent [19]

Yamauchi et al.

[11] Patent Number: 4,488,367

[45] Date of Patent: Dec. 18, 1984

[54] PAGE TURNING APPARATUS

[75] Inventors: Masahide Yamauchi, Kawasaki; Kunio Fukatsu, Ebina, both of Japan

[73] Assignee: Tokyo Shibaura Denki Kabushiki Kaisha, Kawasaki, Japan

[21] Appl. No.: 401,715

[22] Filed: Jul. 26, 1982

[30] Foreign Application Priority Data

Jul. 31, 1981 [JP] Japan ..... 56-120144

[51] Int. Cl.[3] ..... G09F 19/00

[52] U.S. Cl. ..... 40/531; 101/296; 235/379; 400/25; 400/28; 400/636

[58] Field of Search ..... 101/229, 230, 231, 296, 101/271, 93, 287; 400/25, 28, 636; 84/486; 235/379; 194/DIG. 26

[56] References Cited

U.S. PATENT DOCUMENTS

| | | | |
|---|---|---|---|
| 2,494,453 | 1/1950 | Reck | 40/531 |
| 4,031,644 | 6/1977 | Rogers | 40/531 X |
| 4,102,071 | 7/1978 | D'Arcy | 40/531 |
| 4,280,036 | 7/1981 | Fukatsu | 235/379 |

FOREIGN PATENT DOCUMENTS

| | | |
|---|---|---|
| 5644691 | 9/1979 | Japan . |
| 5658893 | 10/1979 | Japan . |

*Primary Examiner*—Edgar S. Burr
*Assistant Examiner*—Moshe I. Cohen
*Attorney, Agent, or Firm*—Cushman, Darby & Cushman

[57] ABSTRACT

Disclosed is an apparatus for selectively turning the pages of a book forward and backward. The apparatus of the present invention comprises a roller, first transfer means, pressing means, driving means, and second transfer means. The roller can rotate selectively in one and the other rotating directions. The first transfer means selectively transfers the roller between first and second positions. The pressing means presses the book against the roller. The driving means drives the roller to rotate selectively in the one and the other rotating directions. The second transfer means moves the book so that one page of the book lifted by the roller is laid on top of the other page. In such construction, the pages of the book can be turned selectively in the forward and backward directions by means of the single roller.

13 Claims, 18 Drawing Figures

PAGE TURNING APPARATUS

BACKGROUND OF THE INVENTION

The present invention relates to a page turning apparatus, more specifically to a page turning apparatus incorporated in an automatic withdrawal machine used in, for example, a bank and capable of selectively turning forward and backward the pages of a passbook inserted into the automatic withdrawal machine.

Conventionally, customers can readily withdraw money from the banks through automatic withdrawal machines. In withdrawing money through one such automatic withdrawal machine, a customer or user opens his passbook at one page to be printed, and then inserts it into the machine. Then, the automatic withdrawal machine reads prescribed information on the customer from the inserted passbook, and prints proper items, such as an amount of money withdrawn, the balance, etc., on the passbook. When the last line of the page at which the passbook is opened is printed, the passbook is transferred to a page turning apparatus, where the page is turned forward for continued printing, and then after printing a new page the passbook is returned to the customer. The page turning apparatus incorporated in the conventional automatic withdrawal machine, however, is subject to the following drawbacks.

For example, if a passbook 1 opened at first and second pages 1*a* and 1*b* is inserted into the conventional withdrawal machine by a customer, as shown in FIG. 1, it will be transferred to a printing apparatus 2. The printing apparatus 2 is provided with a page turning apparatus 3 which turns those pages of the passbook 1 which are on the forward side only in the forward direction. On the forward side of the printing apparatus 2, a print head 4, which can rotate only in a direction indicated by arrow A, lies on a conveyor path 5 at a fixed position. Further provided is a pad 6 to press the first page 1*a* of the passbook 1 against the print head 4 in turning the first page 1*a*.

With use of such construction, only the first page 1*a* of the passbook can be turned, that is, the pages of the passbook can be turned only in the forward direction.

According to the prior art apparatus, however, if two or more pages are turned at a time by mistake, or if a passbook inserted by a user is opened at a wrong page on the foward side, the page or pages will not be able to be turned back.

Accordingly, there may be provided an apparatus with can selectively turn the first and second pages 1*a* and 1*b* by the use of another page turning roller which can rotate only in a direction opposite to the direction indicated by arrow A, as well as the page turning print head 4 rotatable only in the direction indicated by arrow A.

However, such an apparatus requires two page turning rollers for the selective turning of the first and second pages. Thus, the apparatus would be complicated in construction and hence require a wide setting space.

SUMMARY OF THE INVENTION

It is, therefore, an object of this invention to provide an apparatus for turning a page of a book capable of selectively turning the page forward and backward with simple mechanism.

According to an aspect of the present invention, there is provided an apparatus for turning a page of a book which is opened in one direction have one page on the forward side and the other page on the backward side and transferred in the one direction, which comprises a roller capable of selectively rotating in one and the other rotating directions, first transfer means for selectively transferring the roller in the one direction between a first position over the one page and a second position over the other page, pressing means for pressing one of the page and the roller against each other, driving means for rotating the roller in the one rotating direction when the roller is in the first position so that the one page is picked up and caused to run on the roller, and for rotating the roller in the other rotating direction when the roller is in the second position so that the other page is picked up and caused to run on the roller, and second transfer means for transferring the book when the one page is located on the roller in the first position so that the roller is shifted from the first position toward the second position, thereby turning the one page, and for transferring the book when the other page is located on the roller in the second position so that the roller is shifted from the second position toward the first position, thereby turning the other page.

DETAILED DESCRIPTION OF THE PREFERRED EMBODIMENT

Referring now to FIGS. 2 to 18, there will be described in detail one embodiment of a page turning apparatus according to the present invention.

Figure 1:
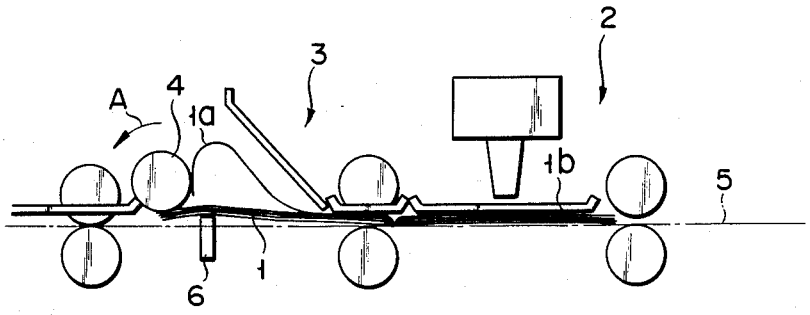
FIG. 1 PRIOR ART
FIG. 1 is a schematic side view of a prior art page turning apparatus.
Figure 2:
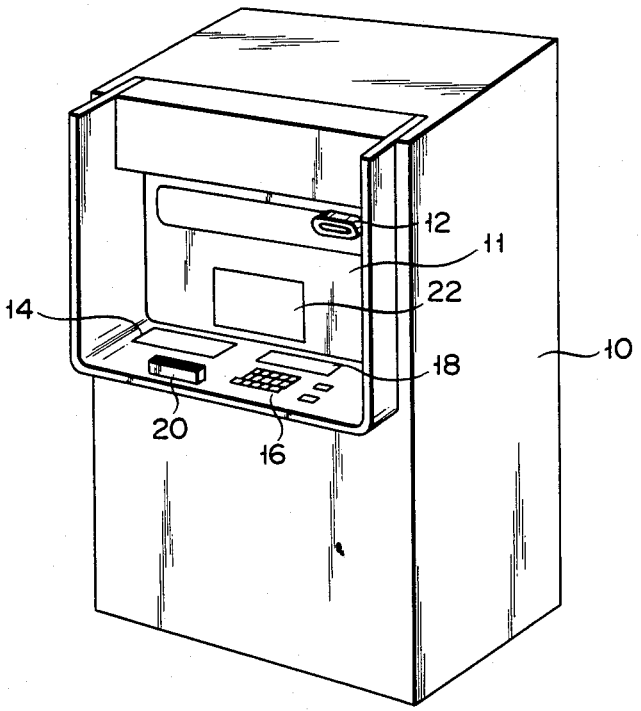
FIG. 2 is a perspective view of an automatic withdrawal machine in which is incorporated an apparatus for turning a page of a book according to an embodiment of the present invention.

FIG. 2 shows an automatic withdrawal machine 10 which incorporates a page turning apparatus 32 of one embodiment. The automatic withdrawal machine 10 is an apparatus which enables a user to withdraw cash and prints have prescribed information on his passbook inserted thereinto by the user by only performing simple operation. The automatic withdrawal machine 10 comprises a housing which is provided with a card inlet 12 through which a cash card is inserted, an operation display unit 14 for displaying operating instructions to be given to the user, control keys 16 to be operated by the user in accordance with the instructions from the operation display unit 14, an amount display board 18 to display an amount of money to be withdrawn, a passbook inlet 20 through which is inserted a passbook 24 (FIG. 3) to be printed which is opened by user at a first page 24*a* of a first leaf 23 on a forward side and a second page 24*b* of a second leaf 25 on a backward side, and a cash return outlet 22 through which the user receives the withdrawn cash.

Figure 3:
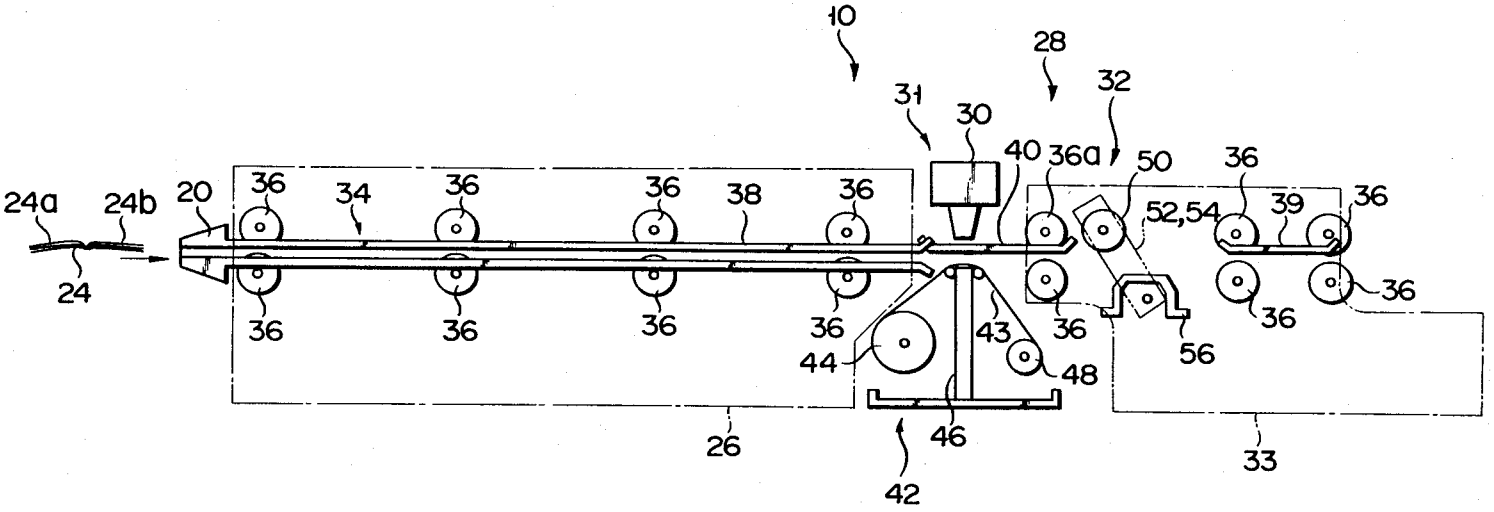
FIG. 3 is a schematic side view showing a flow of a passbook inside the automatic withdrawal machine shown in FIG. 2.

Referring now to FIG. 3, there will be given an outline of the internal construction of the automatic withdrawal machine 10. The automatic withdrawal machine 10 comprises a front unit 26 and a printing apparatus 28. The printing apparatus 28 includes a printing section 31 with a print head 30 and a rear unit 33 housing the page turning apparatus 32 therein.

A conveyor 34 extends through both the front unit 26 and the printing apparatus 28. The conveyor 34 is to convey the passbook 24 from the inlet 20 to the page turning apparatus 32, and then from the page turning apparatus 32 back to the inlet 20. It comprises pairs of rollers 36. Each pair of rollers 36 are so located as to pinch the passbook 24 and to convey the same when rotated. The passbook 24 opened at pages 24*a* and 24*b* is inserted into the inlet 20 and conveyed toward the print head 30. Second page 24*b* reaches the head 30, and first page 24*a* then reaches the head 30. A roller 36*a* located at front of the page turning apparatus 32 is pinch roller which is movable in the vertical direction so as not to prevent the movement of the shutter 40 (mentioned hereinafter). The paired conveyor rollers 36 are arranged at regular intervals along the conveyor 34. The interval between the conveyor rollers 36 along the conveying direction thereof is so set that the distance between the respective centers of each two adjacent rollers 36 is equal to the width of a page of the passbook 24 along the conveying direction. Thus, the passbook 24 can smoothly travel on the conveyor 34 for being always pinched two positions on the passbook.

The printing apparatus 28 includes a shutter 40 movable along the conveyor 34 between the print head 30 and the rear unit 33, and a journal section 42 located under the print head 30 to keep a copy of the prescribed information for a bank concerned. The conveyor 34 is defined by a first conveyor guide 38 attached to the front unit 26 and a second conveyor guide 39 attached to the printing appatatus 28, and a extend of movement of the shutter 40. The journal section 42 is provided with journal paper 43 to be printed by the print head 30, a supply shaft 44 to supply the journal paper 43, and a platen 46 disposed under the journal paper 43 to press it flat against the print head 30. Further, the rear unit 33 included in the printing apparatus 28 is provided with a single roller 50 disposed on the conveyor 34 and capable of rotating clockwise and counterclockwise, first and second arms 52 and 54 supporting the roller 50 and movable along the conveying direction, and a pad 56 to press the passbook 24 against the roller 50.

Referring also to FIG. 3, there will be described an outline of the flow of the passbook 24 in the automatic withdrawal machine 10. The passbook 24 inserted through the passbook inlet 20 is carried along the conveyor 34 and then passes through the front unit 33. In the meantime, the shutter 40 is moved from the position under the print head 30 shown in FIG. 3 to the position where the rear end portion of the sutter 40 engages the front end portion of the second conveyor guide 39 of the rear unit 33. Then, the print head 30 prints the prescribed information on the journal paper 43. The journal paper 43 is supplied from the supply shaft 44, and is wound on a take-up shaft 48 via the platen 46. When the printing on the journal paper 43 is finished, the shutter 40 is moved to the position where its front end portion engages the rear end portion of the first conveyor guide 38, as shown in FIG. 3, and the passbook 24 is set under the print head 30, guided by the first conveyor guide 38 and the shutter 40. Hereupon, the shutter 40 is moved again to the position where it engages the second conveyor guide 39, and is removed from the region under the print head 30. Then, the passbook 24 is printed by the print head 30. Subsequently, in order to turn the leaf 25 including the second page 24b of the passbook 24, the shutter 40 is relocated under the print head 30, as shown in FIG. 3, to carry the passbook 24 into the rear unit 33.

Figure 4:
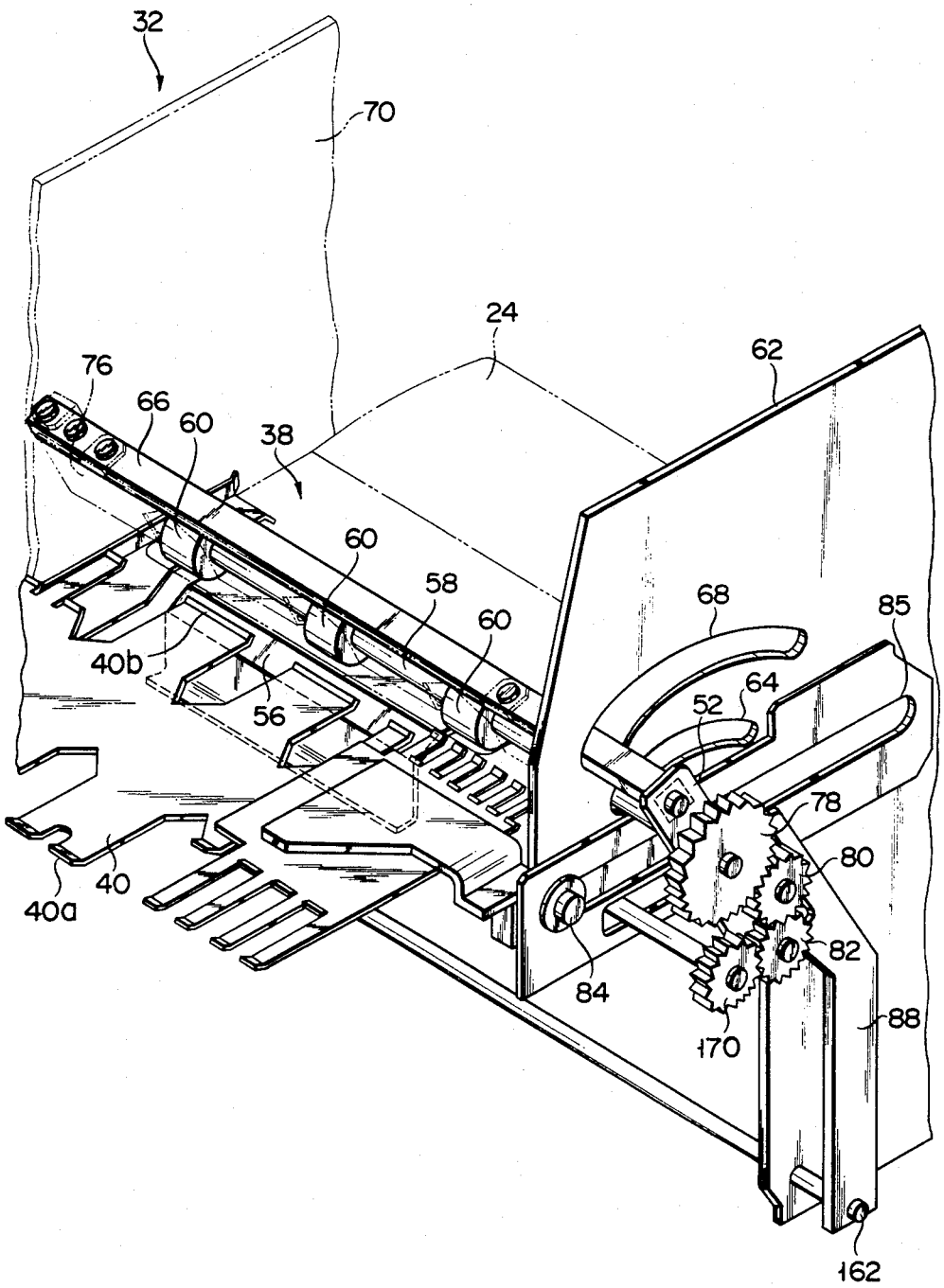
FIG. 4 is a perspective view of the page turning apparatus shown in FIG. 3.

Referring now to FIG. 4, the page turning apparatus 32 will be described in detail.

As shown in FIG. 4, the rear unit 33 including the page turning apparatus 32 comprises the roller 50 located over the conveyor 34 and capable of rotating both clockwise and counterclockwise about its central axis, the shutter 40 movable along the conveying direction, and the pad 56 to press the conveyed passbook 24 against the roller 50.

The roller 50 has a first shaft 58 crossing the conveyor 34. Three roller portions 60 to rotate with the first shaft 58 are fixed thereto at equal spaces. One end portion of the first shaft 58 is pivotally supported by the first arm 52 on one side of the conveyor 34, penetrating a first slot 64 bored through a first plate 62. Fixed to the upper end portion of the first arm 52 is a second shaft 66 to support the first and second arms 52 and 54 (FIG. 6) parallel to each other across the conveyor 34, having one end portion penetrating a second slot 68 bored through the plate 62. The other end portion of the second shaft 66 is pivotally supported by the upper end portion of the second arm 54, penetrating a third slot 72 (FIG. 6) bored through a second plate 70. The other end portion of the first shaft 58 supporting the roller portions 60 is rotatably supported by a bearing (not shown) protruding downward from the second shaft 66. The second shaft 66 is in the shape of a quadrangular prism. A guide plate 76 (represented by a dot-and-dash line in FIG. 4) for guiding a page being lifted up along the roller portions 60 is screwed to the upper surface of the second shaft 66, extending toward the roller portions 60. A gear 78 is concentrically fixed to the one end of the first shaft 58 with the aid of the first arm 52. The gear 78 is in mesh with a gear 80, which is in mesh with a gear 82.

Both ends 40*a* and 40*b* of the shutter 40 opposed along the conveyor 34 are complicated in shape and directed upward from the conveyor 34. The shutter 40 is supported by third and fourth shafts 84 and 86. The fourth shaft 86 is supported by third and fourth arms 88 and 90, penetrating a slot 85 in the first plate 62 and a slot 87 (FIG. 6) in the second plate 70.

Figure 5:
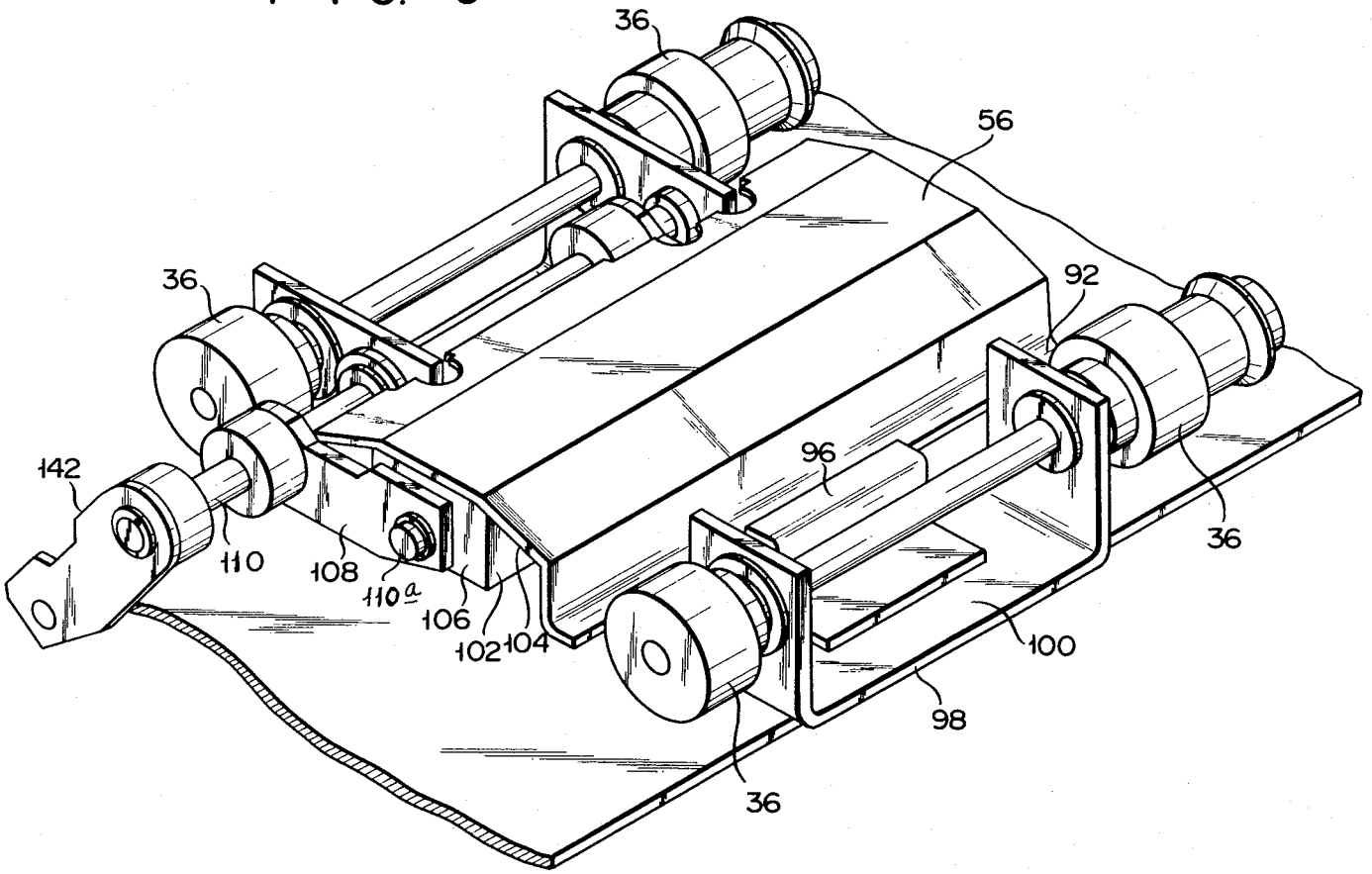
FIG. 5 is a perspective view of a pad shown in FIG. 4.

Under the conveyor 34 lies the pad 56 to press the passbook 24 against the roller portions 60. The pad 56 has a convex shape, as shown in FIG. 5. Both end portions 92 and 94 of the pad 56 opposed along the conveying direction are bent outward to extend parallel to the conveyor 34. A projected member 96 to regulate the upward movement of the pad 56 is located parallel to the upper surface of the one end portion 92 of the pad 56 at a given distance therefrom. The projected member 96 is fixed to a bottom portion 100 of a concave support member 98 which supports one of the conveyor rollers 36 at one end. A support member 102 is fixed to a lower surface 104 of the pad 56 so as to intersect the conveyor 34 at right angles. One end 106 of the support member 102 is formed integrally with the pad 56 so as to be flush with one side edge of the pad 56 parallel to the conveyor 34. The support member 102 extends from the one side edge of the pad 56 to cover nearly $\frac{2}{3}$ of the width of the pad 56. One end of a fifth arm 108 is rockably mounted on the one end 106 of the support member 102 by shaft 110*a*. The other end of the fifth arm 108 is fixed to a fifth shaft 110. Likewise, the other end (not shown) of the support member 102 is fixed to the fifth shaft 110 by means of another arm. An eighth arm 142 is rockable around the fifth shaft 110. The other end portion of the fifth arm 108 is fixed to one end portion of the fifth shaft 110. Like the projected member 96, the fifth shaft 110, whose lower portion is located flush with the projected member 96, regulates the movement of the other end portion 94 (FIG. 6) of the pad 56.

Figure 6:
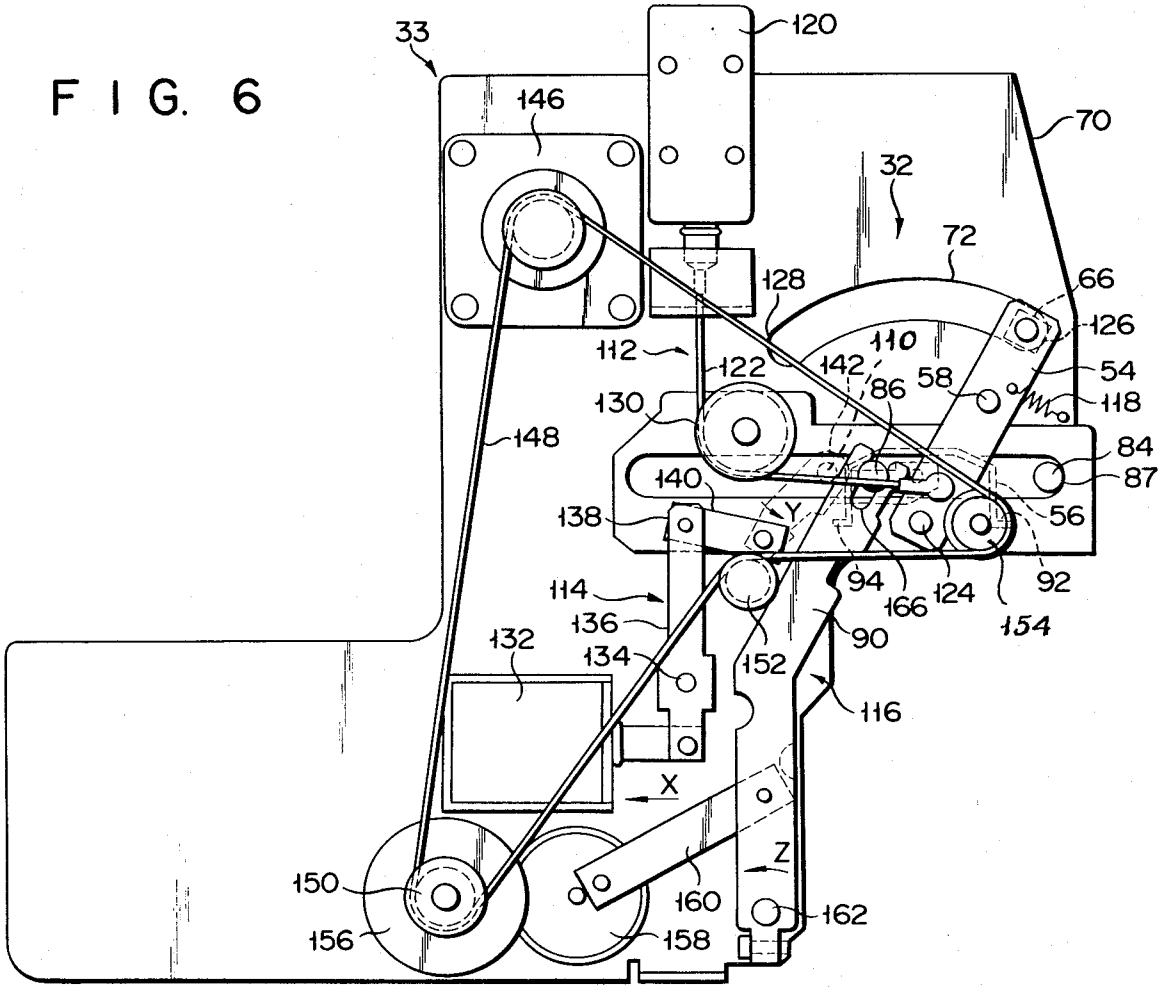
FIG. 6 is a right side view of the page turning apparatus shown in FIG. 4.
Figure 7:
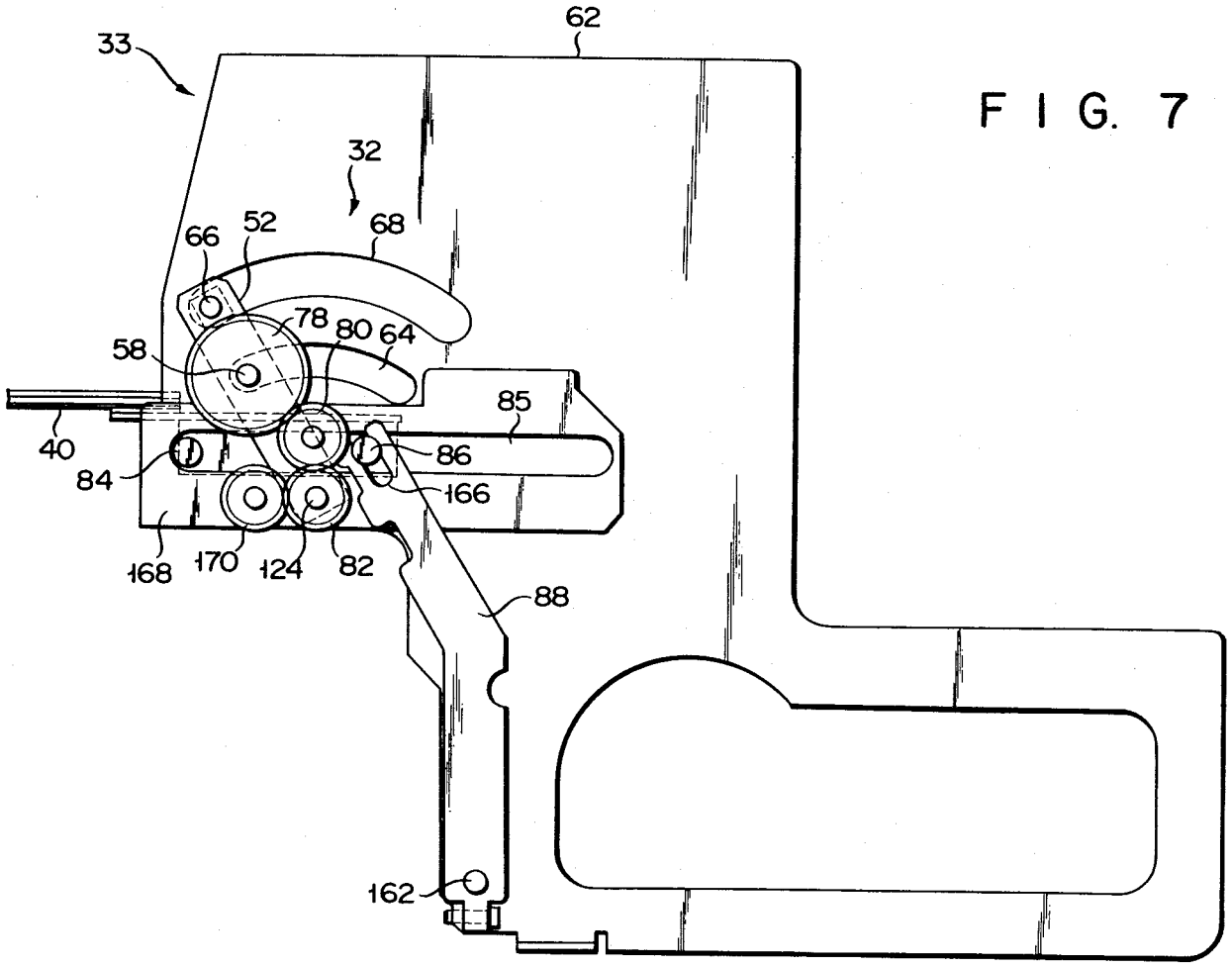
FIG. 7 is a left side view of the page turning apparatus shown in FIG. 4.

Referring now to FIGS. 6 and 7, there will be described drive mechanisms for the page turning apparatus.

FIG. 6 shows an arm drive mechanism 112, a pad drive mechanism 114, and a shutter drive mechanism 116. The arm drive mechanism 112 includes the arm 54, a spring 118 for urging the arm 54 in one direction, a first plunger 120, and a wire 122 connected with the plunger 120 and the second arm 54. The lower end portion of the arm 54 is pivotally mounted on a shaft 124 so that the arm 54 may rock around the shaft 124. The third slot 72 in the first plate 70 in which the support shaft 66 is fitted has first and second end portions 126 and 128. The second arm 54 is provided with the spring 118 having one end connected with the second arm 54 and the other end fixed to the plate 70. The spring 118 normally urges the arm 54 toward the first end portion 126. One end of the wire 122 is fixed to that portion of the second arm 54 which is positioned between the center shaft 124 thereof and that portion thereof which is connected with the spring 118, and the other end of the wire 122 is connected with the first plunger 120. The second arm 54 is inclined so that the second shaft 66 is normally brought into contact with the first end portion 126 by the urging force of the spring 118. When the first plunger 120 is actuated, the wire 122 causes the second arm 54 to rock against the urging force of the spring 118 to be located in a position where the second shaft 66 abuts against the second end portion 128.

The pad drive mechanism 114 includes a second plunger 132 and a sixth arm 136 having one end connected with the second plunger 132 and capable of rocking around a rocking center 134. The eighth arm 142 is pivotally mounted on the other end 138 of the sixth arm 136 by means of a seventh arm 140 so as to be rockable around the fifth shaft 110. Also, the other end of the fifth arm 108 is fixed to the fifth shaft 110, while the one end of the arm 108 is fixed to the support member 102 located inside the pad 56. Thus, when the second plunger 132 is actuated, the sixth arm 136 rocks in the direction indicated by arrow X, and the eighth arm 142 rocks around the fifth shaft 110 with the aid of the seventh arm 140, thereby lifting up the pad 56.

The shutter drive mechanism 116 includes a motor 146 as a drive source having a shaft capable of rotating both clockwise and counterclockwise, and the rotation of the motor 14 is transmitted to pulleys 150, 152 and 154 by means of a belt 148. The pulley 150 is provided with a gear 156 being coaxially therewise and the gear 156 is connected with a gear 158 through a clutch mechanism. One end of a ninth arm 160 is pivotally mounted on that portion of the gear 158 which is at a given radial distance from the center of the gear 158. The other end of the ninth arm 160 is pivotally mounted on the fourth arm 90 rockable around a shaft 162. A recess 166 is formed at the opposite end portion of the fourth arm 90 to the shaft 162 so as to support the fourth shaft 86 supporting a shutter guide and to allow the fourth shaft 86 to move parallel to the conveyor 34 as the fourth arm 90 rocks around the shaft 162. According to such an arrangement, when the motor 146 is driven and the gears 156 and 158 are connected to each other by the clutch mechanism the arm 160 causes the arm 90 to rotate in the direction indicated by arrow Z. Thus, the fourth shaft 164 of the shutter 40 supported by the upper end of the arm 90 is moved parallel to the conveyor 34.

Now a rotating mechanism 168 for the roller 50 will be described. As shown in FIG. 7, the gear 78 is coaxially fixed to the one end portion of the first shaft 58 supported by the first arm 52. The gear 78 is coupled with the gear 82 coaxial with the shaft 124 of the arms by means of the gear 80. The gear 82 is in mesh with a gear 170 which is coaxially fixed to the pulley 154 shown in FIG. 6. Thus, when the rotation of the motor 146 is transmitted to the pulley 154 (FIG. 6), it is transmitted also to the gear 170 coaxial with the pulley 154, and then to the gear 82 which is normally in mesh with the gear 170 independently of the rocking of the arms. Further, the rotation of the gear 82 is transmitted to the gear 78 through the gear 80 to rotate the page turning rollers 60.

Referring now to FIGS. 8 to 18, there will be described page turning operation according to the present embodiment.

Figure 8:
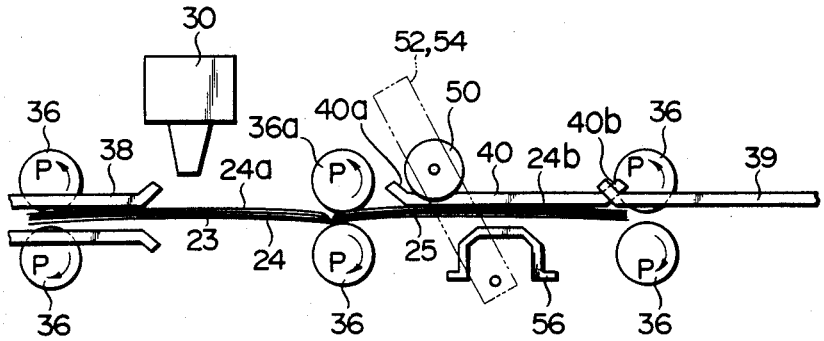
FIGS. 8 to 18 are schematic side views for illustrating various operating states of the page turning apparatus.

While the passbook 24 having the first page 24*a* of the first leaf 23 on the forward side and the second page 24*b* of the second leaf 25 on the backward side is being printed by the print head 30, as shown in FIG. 8, the shutter 40 is moved along the conveyor 34 to be located off the position under the print head 30 so that the end portion 40*b* of the shutter 40 engages the front end of the second conveyor guide 39. Hereupon, after the printing on the first page 24*a* of the passbook 24 is completed, the following page turning operation is performed in order to continue printing on the next page.

While the end portion 40*b* of the shutter 40 is engaged with the front end of the second conveyor guide 39, as shown in FIG. 8, each conveyor roller 36 is rotated in the direction indicated by arrow P to move the passbook 24 toward the second conveyor guide 39.

Figure 9:
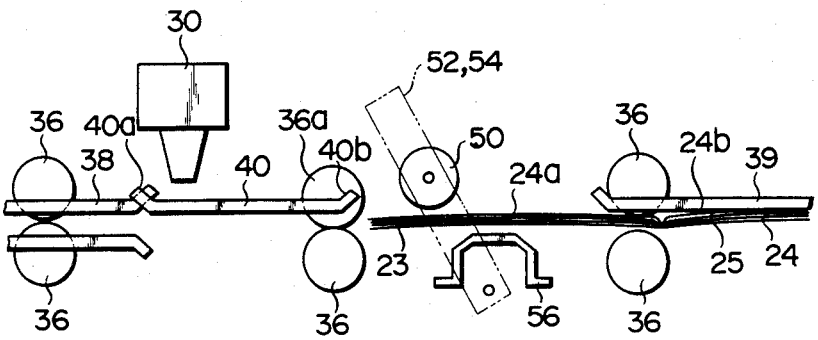

When the passbook 24 is set in position, the shutter 40 is located in the position under the print head 30 where the end portion 40*a* of the shutter 40 engages the rear end of the first conveyor guide 38, as shown in FIG. 9.

Figure 10:
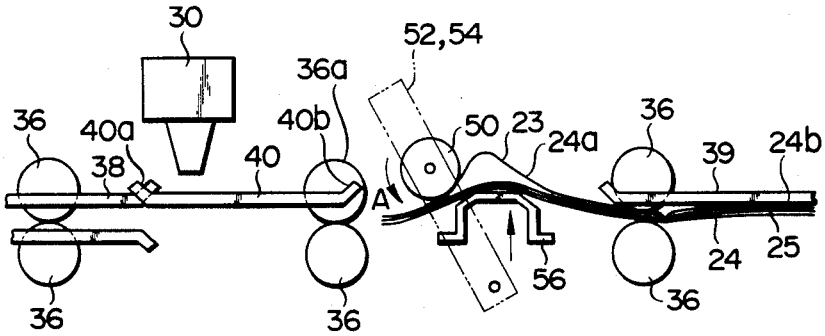

Subsequently, the pad 56 is pushed up from under the back of the passbook 24 to press the first leaf 23 against the roller 50, as shown in FIG. 10, and the roller 50 is rotated in the direction indicated by arrow A in this state. Then, the first leaf 23 is windingly forced up as the roller 50 rotates, as shown in FIG. 10.

Figure 11:
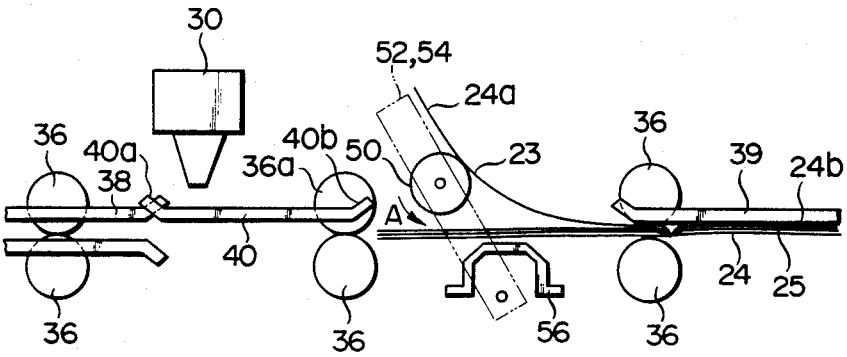

Thereafter, when the pad 56 is lowered to keep the passbook 24 and the roller 50 apart, the first leaf 23 in contact with the roller 50 is further forced up, guided by the guide plate 76 (FIG. 4), and is laid on the roller 50 so as to overhang the same, as shown in FIG. 11.

Figure 12:
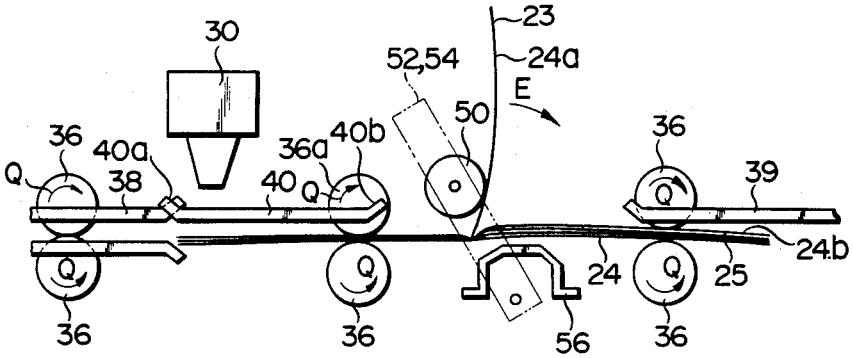

Subsequently, as shown in FIG. 12, the conveyor rollers 36 are rotated in the directions indicated by arrows Q to move the passbook 24 toward the first conveyor guide 38. Then, the first leaf 23 falls down in the direction indicated by arrow E.

Figure 13:
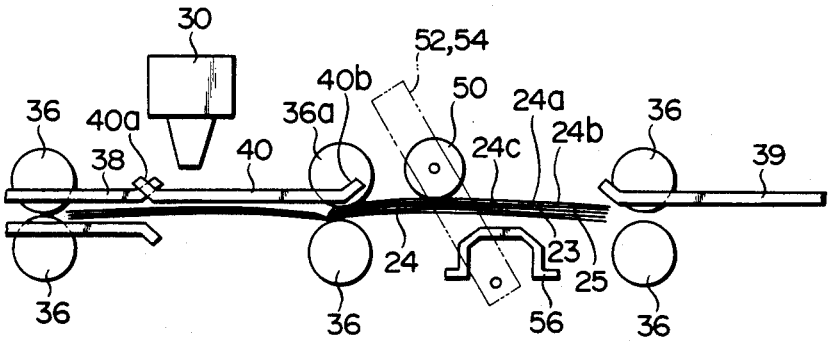

When the passbook 24 is further moved, the first page 24*a* is laid on top of the second page 24*b*, as shown in FIG. 13. Thereafter, the first page 24*a* of the passbook 24 is moved to the position under the print head 30, and then the shutter 40 is moved so that the end portion 40*b* thereof engages the front end of the second conveyor guide 39. In this state, a new page 24*c* of the passbook 24 is printed by the print head 30.

If a leaf is pushed or lifted excessively for forward turning or is required to be turned back for printing, or if two or more leaves are turned at a time by mistake, then the leaf or leaves will have to be turned in the backward direction. Namely, the second leaf 25 need be turned.

Figure 14:
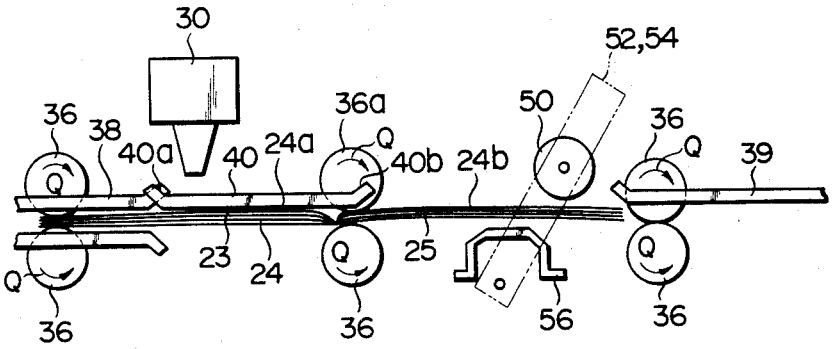

In this case, each conveyor roller 36 is rotated in the direction indicated by arrow Q, so that the passbook 24 is moved toward the first conveyor guide 38 to be set in position, as shown in FIG. 14. At this time, the shutter 40 is moved so that the end portion 40*a* thereof engages the rear end of the first conveyor guide 38. Then, the arms 52 and 54 rock to move and set in position the roller 50 supported thereby, as shown in FIG. 14.

Figure 15:
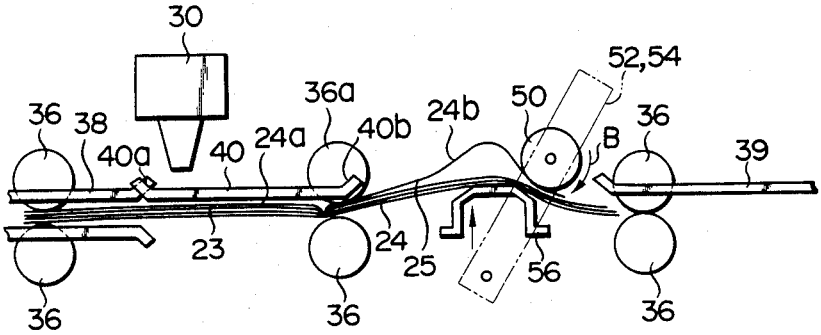

Subsequently, the pad 56 is pushed up under the back of the passbook 24 to press the second leaf 25 against the roller 50, and the roller 50 is rotated in the direction indicated by arrow B in this state, as shown in FIG. 15. Then, the second leaf 25 is forced up as the roller 50 rotates, as shown in FIG. 15.

Figure 16:
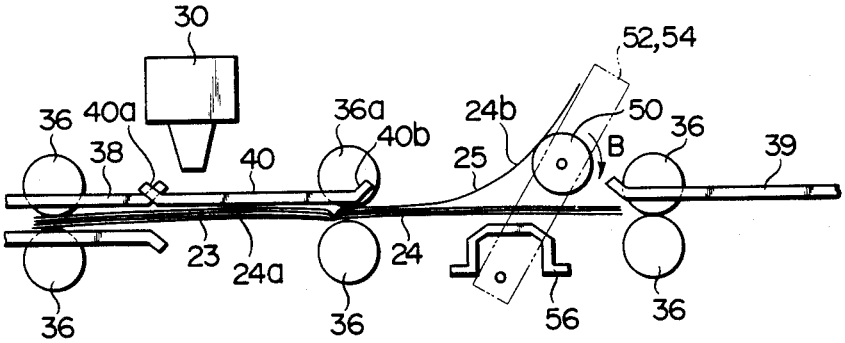

Thereafter, when the pad 56 is lowered to separate the passbook 24 from the roller 50, as shown in FIG. 16, the second leaf 25 in contact with the roller 50 is further lifted to be located on the roller 50, guided by the guide plate 76 (FIG. 4).

Figure 17:
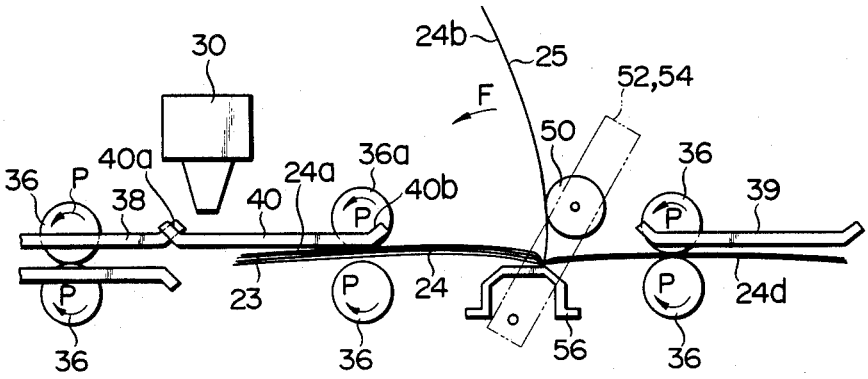

Subsequently, as shown in FIG. 17, each conveyor roller 36 is rotated in the direction indicated by arrow P, so that the passbook 24 is moved toward the second conveyor guide 39. Then, the second leaf 25 falls down in the direction indicated by arrow F.

Figure 18:
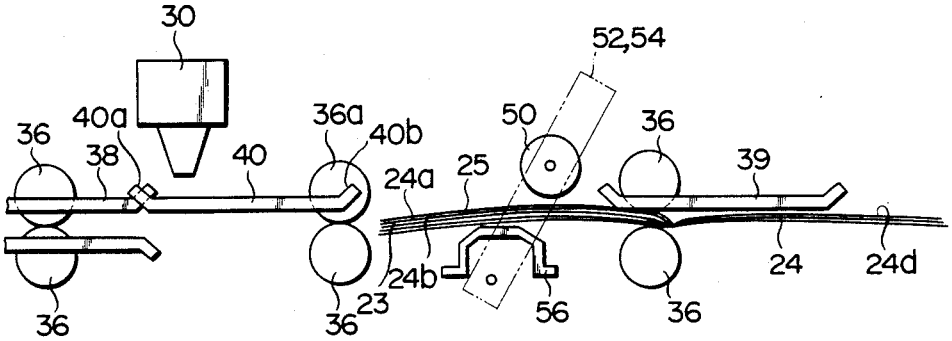

When the passbook 24 is further moved, the second page 24*b* is laid on top of the first page 24*a*, that is, turned, as shown in FIG. 18. Thereafter, the passbook 24 is moved so that a page 24*b* of the second leaf 25 is located under the print head 30, and then the shutter 40 is moved so that the end portion 40*b* thereof engages the front end of the second conveyor guide 39. In this state, the new page 24*d* of the passbook 24 is printed by the print head 30.

Thus, the pages of the passbook can be turned both forward and backward for printing by means of the single roller 50.

It is to be understood that in the present embodiment the rear unit 33 is provided with a detector for detecting an erroneous double leaf turning, and a control device for instructing the printing section according to the invention to turn back the superposed pages in response to an output from the detector.

The present invention is not limited to the above-mentioned embodiment, and various changes and modifications may be effected therein by one skilled in the art without departing from the scope or spirit of the invention.

Although in the above embodiment the apparatus of the invention has been described as being used in an automatic withdrawal machine capable of cash withdrawal, it may also be applied to an automatic depositing and withdrawal machine which enables both withdrawal and depositing.

Further, the machine in which the apparatus of the invention is incorporated is not limited to the automatic withdrawal machine used in a bank. For example, the apparatus may be incorporated in a copying machine to turn automatically the pages of a book being copied.

In the foregoing embodiment, moreover, the page turning apparatus of the invention set in the conveyor for the passbook is located behind the print means. Alternatively, however, the page turning apparatus may be located ahead of the print means.

In the foregoing embodiment, furthermore, the printing lines of the passbook are parallel to the direction in which the passbook is opened. The apparatus of the invention may, however, be applied also to an automatic withdrawal machine which uses a passbook of such a type that the printing lines extend at right angles to the passbook opening direction. In this case, the withdrawal machine requires rotating means for rotating the passbook by 90 degrees before the passbook is carried into the page turning apparatus of the invention.

In the above embodiment, the arms supporting the roller are so designed as to rock around their respective one end portions. The arms will, however, be able to produce the same effect if they are so set as to move parallel along the conveyor.

What we claim is:

1. An apparatus for turning a page of a book which is opened to expose a pair of pages lying within a plane of conveyance of the book, said apparatus comprising:

a roller capable of selectively rotating in first and second opposite directions;

first transfer means for selectively transferring said roller along a conveyance path between a first position above one page of said pair of exposed pages and a second position above the other page of said pair of exposed pages, wherein said one and other pages are picked up and caused to run onto said roller when said roller is respectively in said first and second positions;

pressing means for pressing said one and other pages against said roller when said roller is respectively in said first and second positions, the pressing force exerted by said pressing means being applied in a direction slightly slanted from a direction perpendicular to the book conveyance plane;

driving means for rotating said roller in said first direction when said roller is in said first position so that said one page is picked up and caused to run onto said roller, and for rotating said roller in said second direction, opposite to said first direction, when said roller is in said second position so that said other page is picked up and caused to run onto said roller; and second transfer means for transferring said book in a conveyance direction within said conveyance plane when said one page is located on said roller in said first position so that said roller is shifted from said first position toward said second position thereby turning said one page, and for transferring said book when said other page is located on said roller in said second position so that said roller is shifted from said second position toward said first position thereby turning said other page.

2. An apparatus according to claim 1, wherein said pressing means includes a pad capable of coming into contact with said book between said first and second positions and movable between a third position at a given distance from said roller and a fourth position where said book is pressed against said roller in said first or second position, and third transfer means for transferring said pad from said third position to said fourth position to thereby turn a page of said book.

3. An apparatus according to claim 1, wherein said driving means includes a motor capable of selectively rotating in said first and second opposite rotating directions and transmitting means for transmitting the rotation of said motor to said roller.

4. An apparatus according to claim 1, wherein said second transfer means includes a conveyor along which said book can slide in said conveyance direction, and conveying means for conveying said book in said conveyance direction while pressing on the surface of said book.

5. An apparatus according to claim 4, wherein said conveying means includes at least two rotatable conveyor rollers arranged at a spaced equal to or shorter than the width of a page of said book along said conveyance direction so as normally to press on said book at two positions.

6. An apparatus according to claim 1, wherein said roller includes a rotating shaft, a roller portion coaxially fixed to said rotating shaft to rotate therewith, and supporting means for supporting said rotating shaft.

7. An apparatus according to claim 6, wherein said supporting means includes a pair of arms supporting both ends, respectively, of said rotating shaft and capable of pivoting around a pivot center thereof in said conveyance direction between said first and second positions.

8. An apparatus according to claim 7, wherein said driving means includes a motor capable of selectively rotating in said one and the other rotating directions and transmitting means for transmitting the rotating of said motor to said roller, said transmitting means includes a first gear having a center of rotation in alignment with the rocking center of said arms and rotated by said motor, and a second gear in mesh with said first gear and coaxially fixed to said rotating shaft.

9. An apparatus according to claim 7, wherein said first transfer means includes first urging means for normally urging said roller toward said first position, and second urging means urging said roller toward said second position against the urging force of said first urging means.

10. An apparatus according to claim 9, wherein said first urging means includes a spring connected with said roller thereby urging said roller toward said first position.

11. An apparatus according to claim 9, wherein said second urging means includes an energization solenoid, and a plunger connected with said roller to shift said roller to said second position by means a magnetic field formed by energization of said solenoid.

12. An apparatus according to claim 9, wherein said first transfer means includes first stop means for stopping said roller at said first position against the urging force of said first urging means, second stop means for stopping said roller at said second position against the urging force of said second urging means.

13. An apparatus according to claim 12, wherein said supporting means includes a rod supported by said arms and extending parallel to said rotating shaft, and a plate having a slot to allow movement of said rod, said slot having two end portions against which said rod abuts when said roller is in said first and second positions, respectively.

* * * * *

UNITED STATES PATENT AND TRADEMARK OFFICE

CERTIFICATE OF CORRECTION

PATENT NO. : 4,488,367

DATED : Dec. 18, 1984

INVENTOR(S) : Masahide Yamauchi et al.

It is certified that error appears in the above-identified patent and that said Letters Patent is hereby corrected as shown below:

The term of this patent subsequent to May 14, 2002 has been disclaimed.

Signed and Sealed this

*Twenty-second* Day of *October 1985*

[SEAL]

*Attest:*

DONALD J. QUIGG

*Attesting Officer*

*Commissioner of Patents and Trademarks—Designate*